US008876329B2

(12) United States Patent
Fields et al.

(10) Patent No.: US 8,876,329 B2
(45) Date of Patent: Nov. 4, 2014

(54) LIGHT-EMITTING DIODE WORK LIGHT INCLUDING ADJUSTABLE LENS

(71) Applicants: Marc Howard Fields, Kingwood, TX (US); Li Dong Xie, Ningbo (CN)

(72) Inventors: Marc Howard Fields, Kingwood, TX (US); Li Dong Xie, Ningbo (CN)

( * ) Notice: Subject to any disclaimer, the term of this patent is extended or adjusted under 35 U.S.C. 154(b) by 0 days.

(21) Appl. No.: 13/886,796

(22) Filed: May 3, 2013

(65) Prior Publication Data

US 2013/0294073 A1 Nov. 7, 2013

(51) Int. Cl.

| | |
|---|---|
| ***F21V 17/02*** | (2006.01) |
| ***F21V 5/04*** | (2006.01) |
| ***F21V 21/08*** | (2006.01) |
| ***F21V 14/06*** | (2006.01) |
| ***F21S 9/02*** | (2006.01) |
| ***F21V 21/096*** | (2006.01) |
| *F21W 131/402* | (2006.01) |
| *F21Y 103/00* | (2006.01) |
| *F21Y 101/02* | (2006.01) |

(52) U.S. Cl.

CPC . *F21V 5/04* (2013.01); *F21V 17/02* (2013.01); *F21W 2131/402* (2013.01); *F21V 21/0832* (2013.01); *F21V 14/06* (2013.01); *F21Y 2103/003* (2013.01); *F21Y 2101/02* (2013.01); *F21S 9/02* (2013.01); *F21V 21/096* (2013.01)

USPC ..... 362/238; 362/239; 362/244; 362/322; 362/324; 362/488

(58) Field of Classification Search

CPC ..... F21V 19/00; F21V 19/001; F21V 19/002; F21V 19/02; F21L 4/00; F21L 4/02; F21L 4/025; F21L 4/027; F21L 14/00; F21L 14/02; F21L 14/023; F21L 14/04; F21L 14/06; F21L 14/065; F21L 4/25; F21Y 2101/03; F21W 2131/406; F21S 9/02; F21S 48/1154; F21S 48/1784; F21S 48/1768; F21S 48/215; F21K 9/10; F21K 9/30; F21K 9/50; F21K 9/58

USPC ..... 362/237, 238, 239, 240, 249.02, 362/249.03, 249.05, 249.07, 249.11, 362/249.12, 277, 280, 311.01, 311.02, 322, 362/323, 324, 396, 488, 489, 496, 512, 543, 362/544, 545, 548, 549

See application file for complete search history.

(56) References Cited

U.S. PATENT DOCUMENTS

| | | | | |
|---|---|---|---|---|
| 4,897,768 | A * | 1/1990 | Thul | 362/191 |
| 7,575,347 | B1 * | 8/2009 | Daly | 362/398 |
| 2003/0133307 | A1 * | 7/2003 | Sugihara et al. | 362/490 |
| 2008/0080179 | A1 * | 4/2008 | Giorgi | 362/232 |

FOREIGN PATENT DOCUMENTS

CN 201377691 Y 1/2010

OTHER PUBLICATIONS

English patent abstract of CN201377691 from Espacenet (1 page).

* cited by examiner

*Primary Examiner* — Thomas M Sember

(74) *Attorney, Agent, or Firm* — Bracewell & Giuliani LLP; Brad Y. Chin

(57) ABSTRACT

In accordance with various embodiments, there is provided a light-emitting diode work light, which includes a housing, a light source comprising a light-emitting diode, and a light focusing assembly comprising a lens and a focusing knob. The light focusing assembly is configured to adjust a focal distance of light emitted from the light source. The focusing knob is configured to adjust a distance between the light source and the lens. In accordance with certain embodiments, the light-emitting diode work light includes a plurality of lights sources and a plurality of light focusing assemblies. Each light focusing assembly includes a lens and a focusing knob, and is configured to adjust a focal distance of light emitted from a respective light source.

9 Claims, 3 Drawing Sheets

LIGHT-EMITTING DIODE WORK LIGHT INCLUDING ADJUSTABLE LENS

RELATED APPLICATION

This application claims the benefit of and priority to Chinese Patent Application No. 201220195285.5, filed on May 3, 2012, now Chinese Utility Model Patent No. CN202660439U, issued on Jan. 9, 2013, which is incorporated herein in its entirety.

BACKGROUND

1. Field of the Invention

Embodiments of the invention generally relate to a work light, and more particularly, to a light-emitting diode (LED) work light including a light source and a corresponding light focusing assembly for focusing light emitted from the light source. In accordance with certain embodiments, the light focusing assembly includes a lens and a focusing knob.

2. Description of the Related Art

With the phasing out of incandescent light sources, LED light sources (or LED lamps) are increasingly being used because they provide numerous advantages over conventional light sources. LED lamps provide a long operational life, high luminance, energy conservation, and environmental protection when compared with conventional light sources. LED lamps are widely used for many applications, such as indoor lighting, automobile head- and tail-lights, street lighting, work lights, etc.

In one example, LED lamps are used as work lights for motor vehicle maintenance LED work lights are compact and lightweight and can be mounted to a work surface or hung under the hood of the motor vehicle for illuminating a general area of the motor vehicle. Because of their compact size, LED work lights can be stored in the trunk of the motor vehicle and used at night should the motor vehicle breakdown or require maintenance. Conventional work lights used for motor vehicle maintenance, however, are unable to adjust the focal distance of the light emitted from the light source, and therefore are limited in providing a focused beam of light onto a particular area of the motor vehicle.

SUMMARY

Embodiments of the invention are generally directed to a work light, and more particularly to a LED work light including a light source and a corresponding light focusing assembly for focusing light emitted from the light source. In accordance with certain embodiments, the light focusing assembly includes a lens and a focusing knob. The light focusing assembly is configured to adjust the focal distance of the light emitted from the light source of the LED work light. In accordance with various embodiments of the invention, the focusing knob is manually operated to adjust a distance between the light source in a lamp cup and the lens in the focusing knob. In accordance with certain embodiments, the LED work light includes a plurality of light sources and corresponding light focusing assemblies.

In particular, in accordance with an embodiment of the invention, there is provided a LED work light, which includes a housing, a light source comprising a light-emitting diode, and a light focusing assembly comprising a lens and a focusing knob. The light focusing assembly is configured to adjust a focal distance of light emitted from the light source. The focusing knob is configured to adjust a distance between the light source and the lens. In accordance with certain embodiments, the light-emitting diode work light includes a plurality of lights sources and a plurality of light focusing assemblies. Each light focusing assembly includes a lens and a focusing knob, and is configured to adjust a focal distance of light emitted from a respective light source.

BRIEF DESCRIPTION OF DRAWINGS

These and other features, aspects, and advantages of the invention are better understood with regard to the following Detailed Description, appended Claims, and accompanying Figures. It is to be noted, however, that the Figures illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

Embodiments of the invention provide a LED work light including a light source and a corresponding light focusing assembly for focusing light emitted from the light source. In accordance with certain embodiments, the light focusing assembly includes a lens and a focusing knob for adjusting the focal distance of light emitted from the light source of the LED work light.

Figure 1:
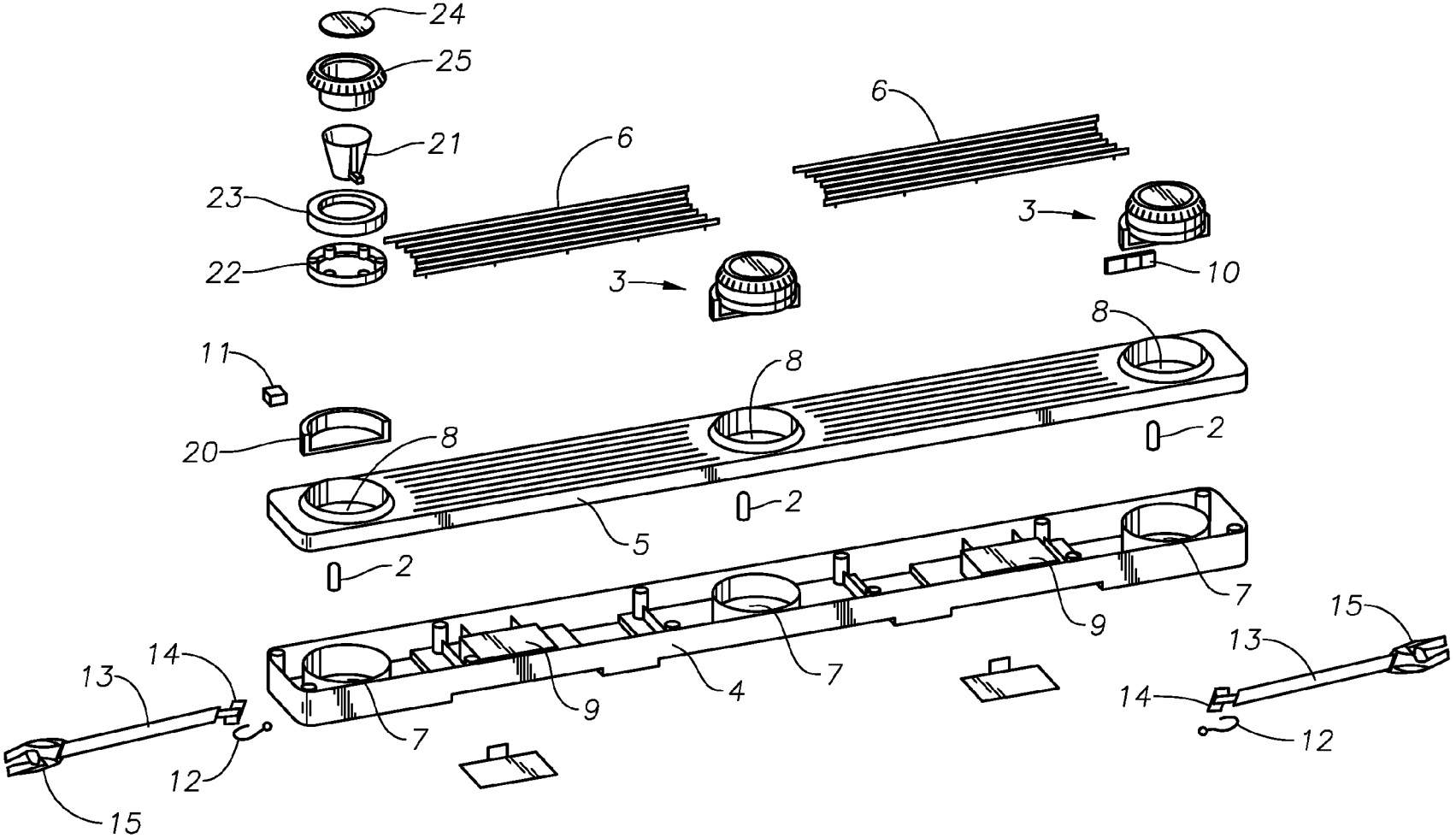
FIG. 1 is an exploded view of a work light, in accordance with an embodiment of the invention.
Figure 2:
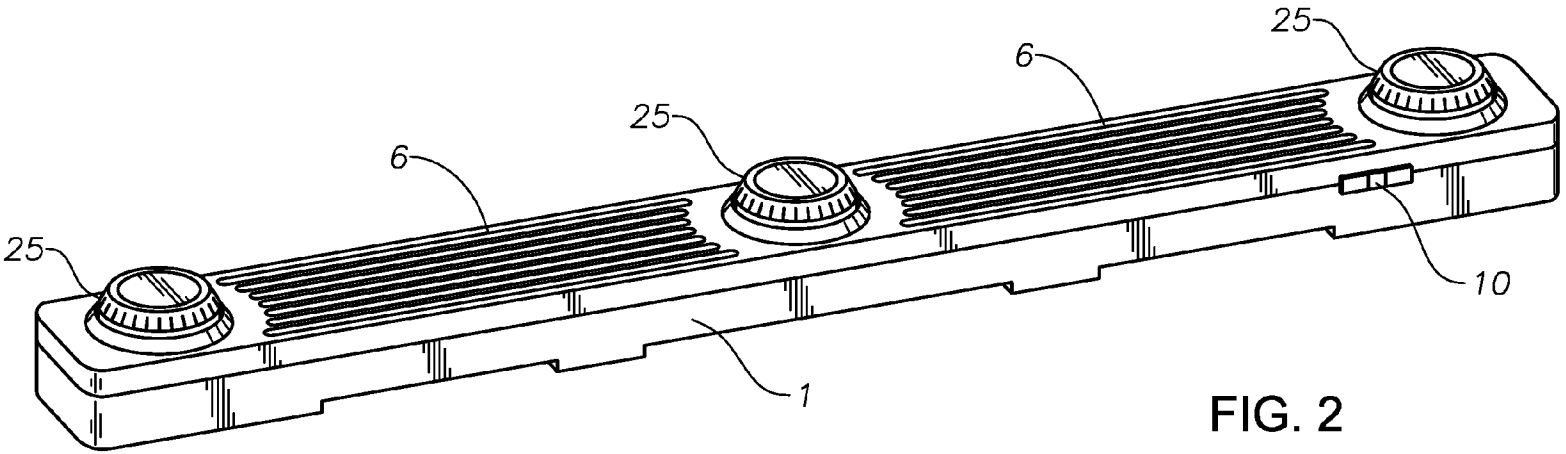
FIG. 2 is a perspective view of the work light, as shown in FIG. 1, assembled, in accordance with an embodiment of the invention.
Figure 3:
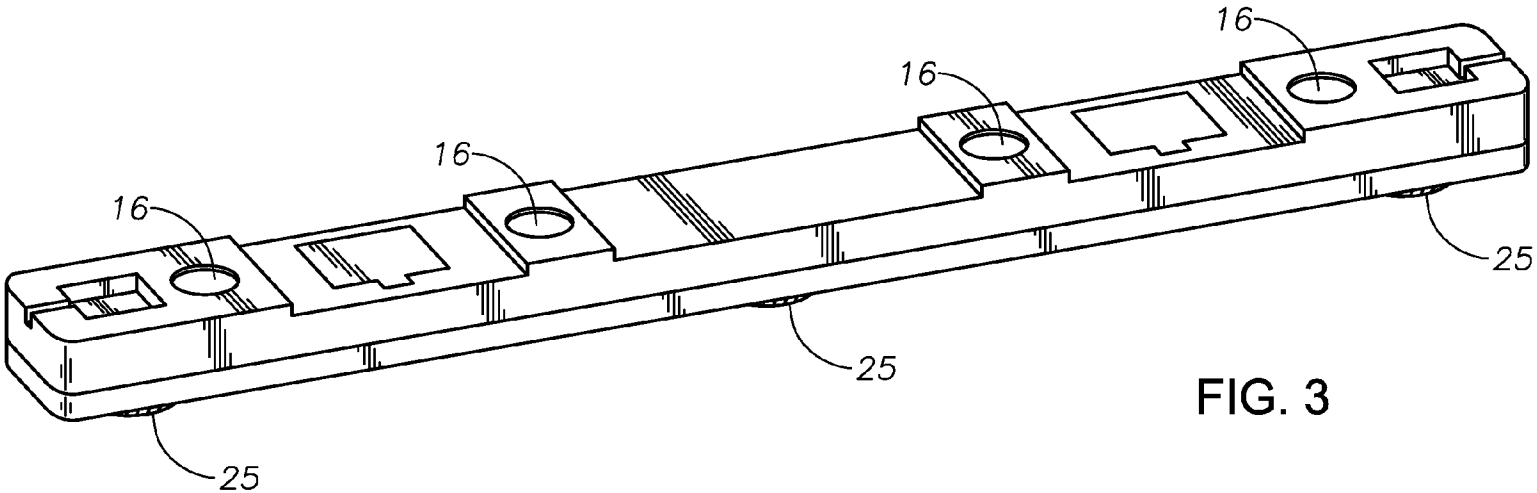
FIG. 3 is another perspective view of the assembled work light, as shown in FIGS. 1-2, in accordance with an embodiment of the invention.
Figure 4:
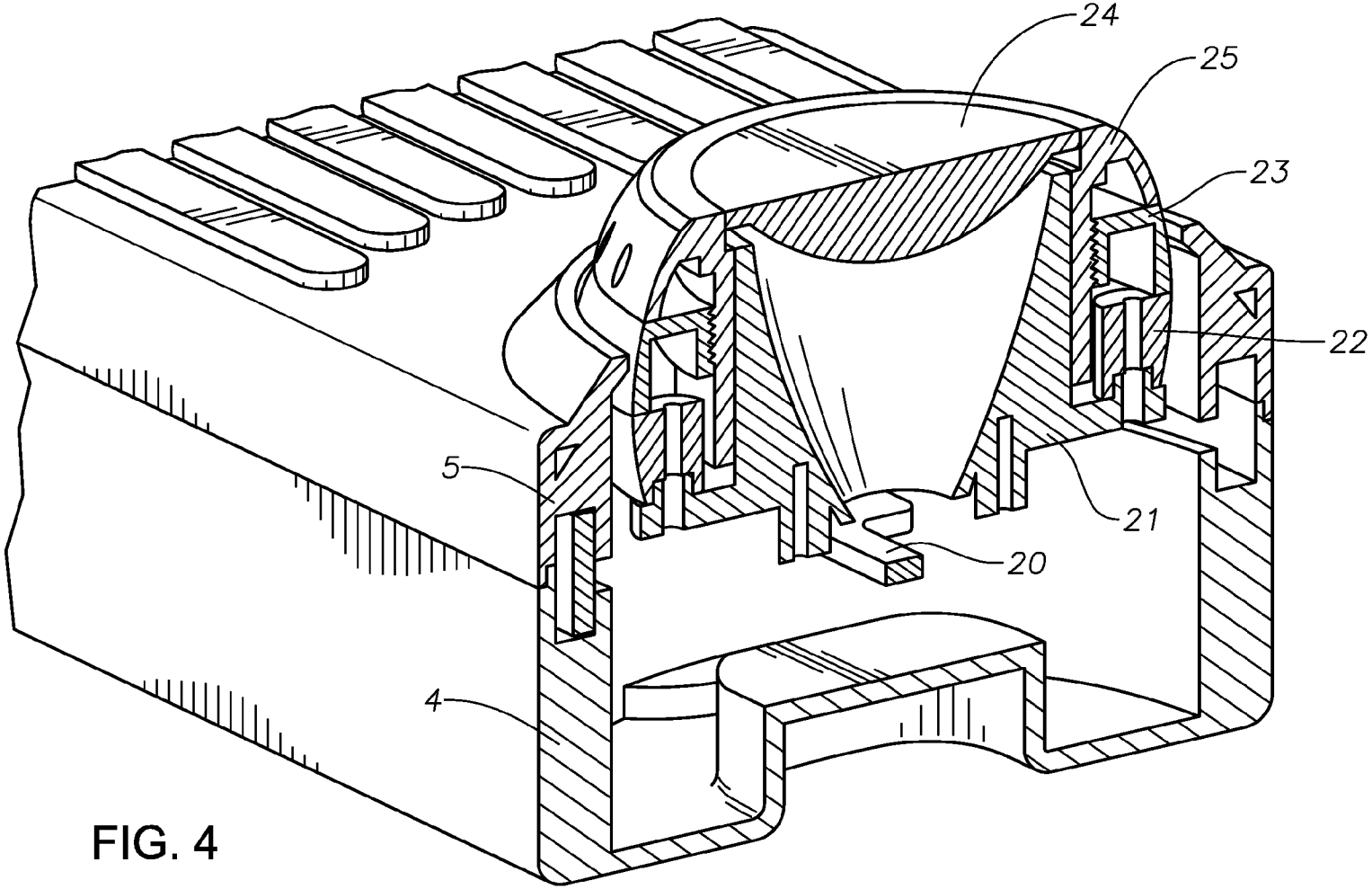
FIG. 4 is a section view of a light focusing assembly for the work light, as shown in FIGS. 1-3, in accordance with an embodiment of the invention.

FIG. 1 is an exploded view of a work light, in accordance with an embodiment of the invention. FIG. 2 is a perspective view of the work light, as shown in FIG. 1, assembled, in accordance with an embodiment of the invention. FIG. 3 is another perspective view of the assembled work light, as shown in FIGS. 1-2, in accordance with an embodiment of the invention. FIG. 4 is a section view of a light focusing assembly for the work light, as shown in FIGS. 1-3, in accordance with an embodiment of the invention. As shown in FIGS. 1-4, the work light, according to various embodiments of the invention, includes a lamp housing 1, a light source 2, and a light focusing assembly 3. In accordance with at least one embodiment, as shown in FIG. 1, the LED work light includes a plurality of light sources 2 and a plurality of corresponding light focusing assemblies 3 contained within the lamp housing 1. The plurality of light sources 2 and the plurality of corresponding light focusing assemblies 3 are spaced apart from one another, so as to be distributed along a length of the lamp housing 1. In accordance with one embodiment, as shown in FIGS. 1-3, the plurality of light sources 2 and the plurality of corresponding light focusing assemblies 3 are positioned at the center and distal ends of the lamp housing 1. One of ordinary skill in the relevant art would have understood that the plurality of light sources 2 and the plurality of corresponding light focusing assemblies 3 could also be positioned along the length of the lamp housing 1 in various clusters or groupings to provide different patterns of light emitted from the LED work light (not shown).

As shown in FIG. 1, the lamp housing 1 includes a base 4 and an upper cover plate 5. In accordance with at least one embodiment, a top surface of the upper cover plate 5 includes one or more decorative strips 6 (see also FIG. 2). The base 4 includes one or more fitting seats 7 contained therein. Each light source 2 and corresponding light focusing assembly 3 is arranged in a respective fitting seat 7. The upper cover plate 5 of the lamp housing 1 further includes one or more through-holes 8 for exposing each light source 2 and corresponding light focusing assembly 3 from the lamp housing 1. Each through-hole 8 is oriented in the upper cover plate 5 in alignment with a respective fitting seat 7, when the base 4 and the upper cover plate 5 are interengaged with one another. In accordance with at least one embodiment, the plurality of through-holes 8 is spaced apart from one another, so as to be distributed along the length of the lamp housing 1. In accordance with one embodiment, as shown in FIGS. 1-3, through-holes 8 are positioned at the center and distal ends of the lamp housing 1. One of ordinary skill in the relevant art would have understood that the plurality of through-holes 8 could also be positioned along the length of the lamp housing 1 in various clusters or groupings to provide different patterns of light emitted from the LED work light (not shown), as long as each through-hole 8 is oriented in alignment with a respective fitting seat 7.

As further shown in FIG. 1, the base 4 of the LED work light, in accordance with various embodiments, further includes one or more battery holders 9, each of which holds a battery used as a power source for the light source 2, and a switch 10 that controls the operation of the light source 2. The switch 10 is located, for example, on the upper cover plate 5. In accordance with other embodiments, the power source of the LED work light includes an external power supply having a DC power supply input terminal 11 and a transformer (not shown). In yet other embodiments, the power source of the LED work light includes a 12V cigarette lighter (not shown).

In accordance with at least one embodiment, the light source 2 includes a LED (e.g., a 1 W high-power LED bulb, as a non-limiting example). One of ordinary skill in the relevant art would have understood that a type and power of the light source 2 could be changed as needed.

In accordance with certain embodiments, the light focusing assembly 3, as shown in detail in FIGS. 1 and 4, includes a swinging strut 20, a lamp cup 21, a lower cover 22, an upper cover 23, a lens 24, and a focusing knob 25. In assembly, the swinging strut 20 is arranged within an opening of the fitting seat 7, and the lamp cup 21 is seated in an opening of the swinging strut 20 and is configured to hold the light source 2 in the lamp housing 1. The lower cover 22 and the upper cover 23 interengage one another around the lamp cup 21 to secure the light focusing assembly 3 to the lamp housing 1. The inner wall of the upper cover 23 includes a set of internal threads, which engage a set of external threads in the outer wall of the focusing knob 25. Lens 24 is installed on the focusing knob 25. In operation, the focusing knob 25 is rotated in a first direction for extending the lens 24 and the focusing knob 25 in a longitudinal direction away from the lamp housing 1, thereby extending a distance between the light source 2 in the lamp cup 21 and the lens 24 in the focusing knob 25. When the focusing knob 25 is rotated in a second direction (e.g., opposite to the first direction), the lens 24 and the focusing knob 25 retract in the longitudinal direction toward the lamp housing 1, thereby shortening the distance between the light source 2 in the lamp cup 21 and the lens 24 in the focusing knob 25. Therefore, by rotating the focusing knob 25 and adjusting the distance between the light source 2 in the lamp cup 21 and the lens 24 in the focusing knob 25, the user of the LED work light is able to adjust the focal distance of the light emitted from the light source 2 of the LED work light, providing better illumination of a specific area, i.e., to provide a focused beam of light onto a particular area of the motor vehicle, as a non-limiting example.

In accordance with at least one embodiment, the LED work light further includes a hook 12 attached at a distal end of the base 4. In accordance with some embodiments, a hook 12 is attached at both ends of the base 4. In accordance with another embodiment of the invention, each hook 12 is coupled to one end of a buckling belt 13 by a fixing buckle 14 for the hook 12, while the other end of the buckling belt 13 includes a clamp 14. In operation, the clamp 14 is securely attached to a motor vehicle hood surface, or any other surface that would allow the user to hang the LED work light near the area to be illuminated. In accordance with another embodiment, an underside of the base 4 includes one or more magnets 16 distributed evenly along the length of the base 4 of the lamp housing 1, to further attach securely the LED work light to the motor vehicle hood surface, or other surface, as needed.

Embodiments of the present invention may suitably comprise, consist or consist essentially of the elements disclosed and may be practiced in the absence of an element not disclosed. For example, it can be recognized by those skilled in the art that certain steps can be combined into a single step.

Unless defined otherwise, all technical and scientific terms used have the same meaning as commonly understood by one of ordinary skill in the art to which this invention belongs.

The singular forms "a," "an," and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

"Optionally" means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

As used herein, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the embodiments of the present invention.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

What is claimed is:

1. A work light, comprising:

a housing;

a light source comprising a light-emitting diode; and a light focusing assembly comprising a lens and a focusing knob, the light focusing assembly configured to adjust a focal distance of light emitted from the light source, wherein the focusing knob is configured to adjust a distance between the light source and the lens, wherein the housing comprises:

a base, a cover plate comprising a through-hole, and a fitting seat configured to hold the light source and the light focusing assembly in the housing, wherein the through-hole is positioned in the cover plate in alignment with the fitting seat in the housing, and wherein the light source and the light focusing assembly are configured to be exposed through the through-hole in the cover plate of the housing, and wherein the light focusing assembly further comprises:

a swinging strut arranged in an opening of the fitting seat, a lamp holder arranged in an opening of the swinging strut, and configured to hold the light source in the housing, and a cover arranged around the lamp holder to secure the light focusing assembly to the housing, cover being configured to operatively engage the focusing knob for adjusting the distance between the light source and the lens.

2. A work light of claim 1, further comprising:

a power source selected from the group consisting of a battery, a DC power supply, and a cigarette lighter.

3. A work light of claim 1, wherein the focusing knob is configured to rotate in a first direction to extend the lens and the focusing knob in a longitudinal direction away from the housing for extending the distance between the light source and the lens, and further configured to rotate in a second direction to retract the lens and the focusing knob in a longitudinal direction toward the housing for shortening the distance between the light source and the lens.

4. A work light of claim 1, thither comprising:

a securing means for attaching the work light to a surface.

5. A work light of claim 4, wherein the securing means comprises:

a hook coupled to a distal end of the housing, a strap coupled to the hook, and a clamp coupled to the strap, and configured to attach the work light to the surface.

6. A work light of claim 4, wherein the securing means comprises a magnet arranged in a bottom surface of the housing.

7. A work light, comprising:

a housing;

a plurality of light sources, each light source comprising a light-emitting diode; and a plurality of light focusing assemblies, each light focusing assembly comprising a lens and a focusing knob, each light focusing assembly configured to adjust a focal distance of light emitted from a respective light source, wherein the focusing knob is configured to adjust a distance between the respective light source and the lens, wherein the housing comprises:

a base, a cover plate comprising a plurality of through-holes, and a plurality of fitting seats, each fitting seat configured to hold the respective light source and a respective light focusing assembly in the housing, wherein each through-hole is positioned in the cover plate in alignment with a respective fitting seat in the housing, and wherein each of the light sources and each of the light focusing assembly is configured to be exposed through a respective through-hole in the cover plate of the housing, and wherein each light focusing assembly further comprises:

a swinging strut arranged in an opening of the respective fitting seat, a lamp holder arranged in an opening of the swinging strut, and configured to hold the respective light source in the housing, and a cover arranged around the lamp holder to secure each light focusing assembly to the housing, the cover being configured to operatively engage the focusing knob for adjusting the distance between the respective light source and the lens.

8. A work light of claim 7, wherein the plurality of light sources and the plurality of light focusing assemblies are distributed along a length of the housing, such that a light source and a light focusing assembly is provided at each distal end and at the center of the housing.

9. A work light of claim 7, wherein the plurality of light sources and the plurality of light focusing assemblies are distributed along a length of the housing, such that at least one light source and at least one corresponding light focusing assembly is grouped together along the length of the housing.

* * * * *

UNITED STATES PATENT AND TRADEMARK OFFICE

CERTIFICATE OF CORRECTION

PATENT NO. : 8,876,329 B2
APPLICATION NO. : 13/886796
DATED : November 4, 2014
INVENTOR(S) : Marc Howard Fields and Li Dong Xie It is certified that error appears in the above-identified patent and that said Letters Patent is hereby corrected as shown below:

In the Claims

In Column 5, Line 30, Claim 1, the line appears as "light focusing assembly to the housing, cover being" and should read --light focusing assembly to the housing, the cover being--.

In Column 5, Line 45, Claim 4, the line appears as "A work light of claim 1, thither comprising" and should read --A work light of claim 1, further comprising--.

Signed and Sealed this
Twenty-fourth Day of March, 2015

Michelle K. Lee

Michelle K. Lee
*Director of the United States Patent and Trademark Office*